US008490719B2

(12) United States Patent
Duhe et al.

(10) Patent No.: US 8,490,719 B2
(45) Date of Patent: Jul. 23, 2013

(54) METHOD AND APPARATUS FOR CONTROLLING BOTTOM HOLE PRESSURE IN A SUBTERRANEAN FORMATION DURING RIG PUMP OPERATION

(75) Inventors: Jason Duhe, Missouri City, TX (US); James May, Houston, TX (US)

(73) Assignee: M-I L.L.C., Houston, TX (US)

( * ) Notice: Subject to any disclaimer, the term of this patent is extended or adjusted under 35 U.S.C. 154(b) by 608 days.

(21) Appl. No.: 12/445,686

(22) PCT Filed: Oct. 23, 2007

(86) PCT No.: PCT/US2007/082245

§ 371 (c)(1),
(2), (4) Date: Jul. 2, 2009

(87) PCT Pub. No.: WO2008/051978

PCT Pub. Date: May 2, 2008

(65) Prior Publication Data

US 2010/0288507 A1 Nov. 18, 2010

Related U.S. Application Data

(60) Provisional application No. 60/862,558, filed on Oct. 23, 2006.

(51) Int. Cl.
*E21B 21/08* (2006.01)
*E21B 47/06* (2012.01)

(52) U.S. Cl.
USPC ..... 175/57; 175/25; 175/48; 166/250.07; 166/250.08

(58) Field of Classification Search
USPC ..... 175/25, 48, 57; 166/250.07, 250.08
See application file for complete search history.

(56) References Cited

U.S. PATENT DOCUMENTS 3,470,972 A * 10/1969 Dower ..... 175/25
3,552,502 A * 1/1971 Wilson, Sr. ..... 175/25

(Continued)

FOREIGN PATENT DOCUMENTS

| | | |
|---|---|---|
| EP | 1532347 | 5/2005 |
| EP | 1356186 | 6/2005 |
| WO | 2006/000799 | 1/2006 |
| WO | WO 2008051978 A1 * | 5/2008 |

OTHER PUBLICATIONS

Roes et al., "First Deepwater Application of Dynamic Annular Pressure Control Succeeds," pp. 1-9, IADC/SPE Drilling Conference, Miami, Florida, Feb. 21-23, 2006.

*Primary Examiner* — Jennifer H Gay
(74) *Attorney, Agent, or Firm* — Brian M. Mattson

(57) ABSTRACT

A method for maintaining pressure in a wellbore during drilling operations includes the steps of providing fluid from a reservoir through a drill string, circulating the fluid from the drill string to an annulus between the drill string and the wellbore, isolating pressure in the annulus, measuring pressure in the annulus, calculating a set point backpressure, applying back pressure to the annulus based on the set point back pressure, diverting fluid from the annulus to a controllable choke, controllably bleeding off pressurized fluid from the annulus, separating solids from the fluid, and directing the fluid back to the reservoir. An apparatus for maintaining pressure in a wellbore during drilling operations includes an adjustable choke for controllably bleeding off pressurized fluid from the wellbore annulus, a backpressure pump for applying a calculated set point backpressure, and a processor for controlling the adjustable choke and backpressure pump.

6 Claims, 6 Drawing Sheets

U.S. PATENT DOCUMENTS 3,677,353 A * 7/1972 Baker ..... 175/25
3,827,511 A * 8/1974 Jones ..... 175/25
4,733,232 A * 3/1988 Grosso ..... 367/82
4,733,233 A * 3/1988 Grosso et al. ..... 367/82
4,867,254 A * 9/1989 Gavignet ..... 175/48
5,070,949 A * 12/1991 Gavignet ..... 175/48
5,080,182 A * 1/1992 Thompson ..... 175/48
6,374,925 B1 4/2002 Elkins et al.
6,484,816 B1 11/2002 Koederitz
6,575,244 B2 6/2003 Chang et al.
6,904,981 B2 6/2005 van Riet et al.
6,920,942 B2 * 7/2005 Koederitz ..... 175/25
7,044,237 B2 5/2006 Leuchtenberg
7,278,496 B2 * 10/2007 Leuchtenberg ..... 175/48
7,350,597 B2 * 4/2008 Reitsma et al. ..... 175/66
7,367,411 B2 * 5/2008 Leuchtenberg ..... 175/48
7,395,878 B2 * 7/2008 Reitsma et al. ..... 175/38
7,562,723 B2 * 7/2009 Reitsma ..... 175/72
7,650,950 B2 * 1/2010 Leuchtenberg ..... 175/48
7,828,081 B2 * 11/2010 Reitsma ..... 175/25
7,836,973 B2 * 11/2010 Belcher et al. ..... 175/25
7,984,770 B2 * 7/2011 Sehsah ..... 175/48
8,016,033 B2 * 9/2011 Iblings et al. ..... 166/244.1
8,122,975 B2 * 2/2012 Belcher et al. ..... 175/57
2002/0112888 A1 8/2002 Leuchtenberg
2003/0024737 A1 * 2/2003 Chang et al. ..... 175/25
2003/0079912 A1 * 5/2003 Leuchtenberg ..... 175/38
2003/0196804 A1 * 10/2003 Riet ..... 166/267
2004/0007131 A1 1/2004 Chitty et al.
2004/0144565 A1 * 7/2004 Koederitz ..... 175/25
2004/0178003 A1 9/2004 van Riet et al.
2005/0092523 A1 5/2005 McCaskill et al.
2005/0096848 A1 5/2005 Hou et al.
2005/0098349 A1 5/2005 Krueger et al.
2005/0222772 A1 * 10/2005 Koederitz et al. ..... 702/6
2006/0037781 A1 2/2006 Leuchtenberg
2006/0113110 A1 6/2006 Leuchtenberg
2006/0175090 A1 * 8/2006 Reitsma et al. ..... 175/25
2007/0151762 A1 * 7/2007 Reitsma ..... 175/40
2007/0151763 A1 * 7/2007 Reitsma et al. ..... 175/48
2007/0227774 A1 * 10/2007 Reitsma et al. ..... 175/25
2007/0246263 A1 * 10/2007 Reitsma ..... 175/38
2008/0060846 A1 * 3/2008 Belcher et al. ..... 175/25
2010/0186960 A1 * 7/2010 Reitsma et al. ..... 166/305.1
2010/0288507 A1 * 11/2010 Duhe et al. ..... 166/370
2011/0024189 A1 * 2/2011 Saeed et al. ..... 175/40
2011/0114387 A1 * 5/2011 Belcher et al. ..... 175/57
2011/0139506 A1 * 6/2011 Lovorn et al. ..... 175/25
2011/0139509 A1 * 6/2011 Pool et al. ..... 175/50
2011/0214882 A1 * 9/2011 Santos ..... 166/373
2011/0290562 A1 * 12/2011 Standifird et al. ..... 175/57
2011/0303462 A1 * 12/2011 Lovorn et al. ..... 175/48
2012/0067591 A1 * 3/2012 Couturier et al. ..... 166/373

* cited by examiner

METHOD AND APPARATUS FOR CONTROLLING BOTTOM HOLE PRESSURE IN A SUBTERRANEAN FORMATION DURING RIG PUMP OPERATION

This application is the National Stage of International Application No. PCT/US07/82245, filed Oct. 23, 2007, which claims the benefit under 35 U.S.C. §119(e) of U.S. Provisional Application No. 60/862,558, filed Oct. 23, 2006.

BACKGROUND OF INVENTION

The exploration and production of hydrocarbons from subsurface formations ultimately requires a method to reach and extract the hydrocarbons from the formation. Referring to FIG. 1, a typical oil or gas well 10 includes a borehole 12 that traverses a subterranean formation 14 and includes a wellbore casing 16. During operation of the well 10, a drill pipe 18 may be positioned within the borehole 12 in order to inject fluids such as, for example, drilling mud into the wellbore. As will be recognized by persons having ordinary skill in the art, the end of the drill pipe 18 may include a drill bit and the injected drilling mud may be used to cool the drill bit and remove particles drilled away by the drill bit. The fluid then circulates back up the annulus formed between the borehole wall and the drill bit, taking with it the cuttings from the drill bit and clearing the borehole. A mud tank 20 containing a supply of drilling mud may be operably coupled to a mud pump 22 for injecting the drilling mud into the drill pipe 18.

Traditionally fluid is selected such that the hydrostatic pressure applied by the fluid is greater than surrounding formation pressure, thereby preventing formation fluids from entering into the borehole 12. It also causes the fluid to enter into the formation pores, or "invade" the formation 14. Further, some of the additives from the pressurized fluid adhere to the formation walls forming a "mud cake" on the formation walls. This mud cake helps to preserve and protect the formation prior to the setting of casing in the drilling process. The selection of fluid pressure in excess of formation pressure is commonly referred to as over balanced drilling.

The annulus 24 between the casing 16 and the drill pipe 18 may be sealed in a conventional manner using, for example, a rotary seal 26. In order to control the operating pressures within the well 10 within acceptable ranges, a choke 28 may be operably coupled to the annulus 24 between the casing 16 and the drill pipe 18 in order to controllably bleed off pressurized fluidic materials out of the annulus 24 back into the mud tank 20 to thereby create back pressure within the borehole 12. The clean, returned fluid flow is measured to determine fluid losses to the formation as a result of fluid invasion. The returned solids and fluid (prior to treatment) may be studied to determine various formation characteristics used in drilling operations. Once the fluid has been treated in the mud pit, it is then pumped out of the mud pit and re-injected into the top of the drill string again. This overbalanced technique relies primarily on the fluid density and hydrostatic force generated by the column of fluid in the annulus to generate pressure. By exceeding the formation pore pressure, the fluid is used to prevent sudden releases of formation fluid to the borehole, such as gas kicks. Where such gas kicks occur, the density of the fluid may be increased to prevent further formation fluid release to the borehole. However, the addition of weighting additives to increase fluid density (a) may not be rapid enough to deal with the formation fluid release and (b) may exceed the formation fracture pressure, resulting in the creation of fissures or fractures in the formation, with resultant fluid loss to the formation, possibly adversely affecting near borehole permeability. In such events, the operator may elect to close the blow out preventors (BOP) below the drilling rig floor to control the movement of the gas up the annulus. The gas is bled off and the fluid density is increased prior to resuming drilling operations.

The use of overbalanced drilling also affects the selection of casing during drilling operations. The drilling process starts with a conductor pipe being driven into the ground, a BOP stack attached to the drilling conductor, with the drill rig positioned above the BOP stack. A drill string with a drill bit may be selectively rotated by rotating the entire string using the rig kelly or a top drive, or may be rotated independent of the drill string utilizing drilling fluid powered mechanical motors installed in the drill string above the drill bit. As noted above, an operator may drill open hole for a period until such time as the accumulated fluid pressure at a calculated depth nears that of the formation fracture pressure. At that time, it is common practice to insert and hang a casing string in the borehole from the surface down to the calculated depth. A cementing shoe is placed on the drill string and specialized cement is injected into the drill string, to travel up the annulus and displace any fluid then in the annulus. The cement between the formation wall and the outside of the casing effectively supports and isolates the formation from the well bore annulus and further open hole drilling is carried out below the casing string, with the fluid again providing pressure control and formation protection.

FIG. 2 is an exemplary diagram of the use of fluids during the drilling process in an intermediate borehole section. The top horizontal bar represents the hydrostatic pressure exerted by the drilling fluid and the vertical bar represents the total vertical depth of the borehole. The formation pore pressure graph is represented by line 40. As noted above, in an over balanced situation, the fluid pressure exceeds the formation pore pressure for reasons of pressure control and hole stability. Line 42 represents the formation fracture pressure. Pressures in excess of the formation fracture pressure will result in the fluid pressurizing the formation walls to the extent that small cracks or fractures will open in the borehole wall and the fluid pressure overcomes the formation pressure with significant fluid invasion. Fluid invasion can result in reduced permeability, adversely affecting formation production. The annular pressure generated by the fluid and its additives is represented by line 44 and is a linear function of the total vertical depth. The pure hydrostatic pressure that would be generated by the fluid, less additives, i.e., water, is represented by line 46.

In an open loop fluid system described above, the annular pressure seen in the borehole is a linear function of the borehole fluid. This is true only where the fluid is at a static density. While the fluid density may be modified during drilling operations, the resulting annular pressure is generally linear. In FIG. 2, the hydrostatic pressure 46 and the pore pressure 40 generally track each other in the intermediate section to a depth of approximately 7000 feet. Thereafter, the pore pressure 40 increases. This may occur where the borehole penetrates a formation interval having significantly different characteristics than the prior formation. The annular pressure 44 maintained by the fluid is safely above the pore pressure prior to the increase. In the depth below the pore pressure increase, the differential between the pore pressure 40 and annular pressure 44 is significantly reduced, decreasing the margin of safety during operations. A gas kick in this interval may result in the pore pressure exceeding the annular pressure with a release of fluid and gas into the borehole, possibly requiring activation of the surface BOP stack. As noted above, while additional weighting material may be added to the fluid, it will be generally ineffective in dealing with a gas kick due to the time required to increase the fluid density as seen in the borehole.

Fluid circulation itself also creates problems in an open system. It will be appreciated that it is necessary to shut off the mud pumps in order to make up successive drill pipe joints. When the pumps are shut off, the annular pressure will undergo a negative spike that dissipates as the annular pressure stabilizes. Similarly, when the pumps are turned back on, the annular pressure will undergo a positive spike. This occurs each time a pipe joint is added to or removed from the string. It will be appreciated that these spikes can cause fatigue on the borehole cake and could result in formation fluids entering the borehole, again leading to a well control event.

In contrast to open fluid circulation systems, there have been developed a number of closed fluid handling systems. A closed system is used for the purposes of underbalanced drilling, i.e., the annular pressure is less than that of the formation pore pressure. Underbalanced drilling is generally used where the formation is a chalk or other fractured limestone and the desire is to prevent the mud cake from plugging fractures in the formation. Moreover, it will be appreciated that where underbalanced systems are used, a significant well event will require that the BOPs be closed to handle the kick or other sudden pressure increase.

Thus it would be an improvement to the art to have a system that can manage pressure in the bore hole throughout drilling operations.

SUMMARY

Embodiments disclosed herein relate to a method for maintaining pressure in a wellbore during drilling operations. The method includes the steps of providing fluid from a reservoir through a drill string, circulating the fluid from the drill string to an annulus between the drill string and the wellbore, isolating pressure in the annulus, measuring pressure in the annulus, calculating a set point backpressure, applying back pressure to the annulus based on the set point back pressure, diverting fluid from the annulus to a controllable choke, controllably bleeding off pressurized fluid from the annulus, separating solids from the fluid, and directing the fluid back to the reservoir.

In another aspect, embodiments disclosed herein related to an apparatus for maintaining pressure in a wellbore during drilling operations, wherein the wellbore has casing set and cemented into place. The apparatus includes a reservoir containing fluid for the wellbore, a drill string in fluid communication with the reservoir, wherein an annulus is defined between the wellbore and the drillstring, a pressure transducer in the drill string to measure pressure in the annulus, a rotating control device isolating pressure in the annulus and communicating fluid from the reservoir to the drill string and diverting fluid and solids from the annulus, an adjustable choke in fluid communication with the rotating control device controllably bleeding off pressurized fluid from the annulus, solids control equipment receiving fluid and solids from the adjustable choke and removing the solids from the fluid, wherein the fluid from the solids control equipment is directed to the reservoir, a processor receiving the measured pressure from the pressure transducer and calculating a set point backpressure, and a backpressure pump in fluid communication with the reservoir and applying a backpressure between the rotating control device and the automatic choke based on the calculated set point backpressure.

Other aspects and advantages of the claimed subject matter will be apparent from the following description and the appended claims.

DETAILED DESCRIPTION

In one aspect, embodiments disclosed herein relate to a method for maintaining pressure in a wellbore during drilling operations. As used herein, the term "drilling operations" includes all operations or activities that take place at the drilling site in connection with drilling a well, including, but not restricted to, the actual act of turning the drill string to cause a rotary drill bit to drill into the formation and including pumping the drilling mud, operating the draw works, the generation of electric power, the running of machinery, all other activities connected with operating a drilling site.

Figure 1:
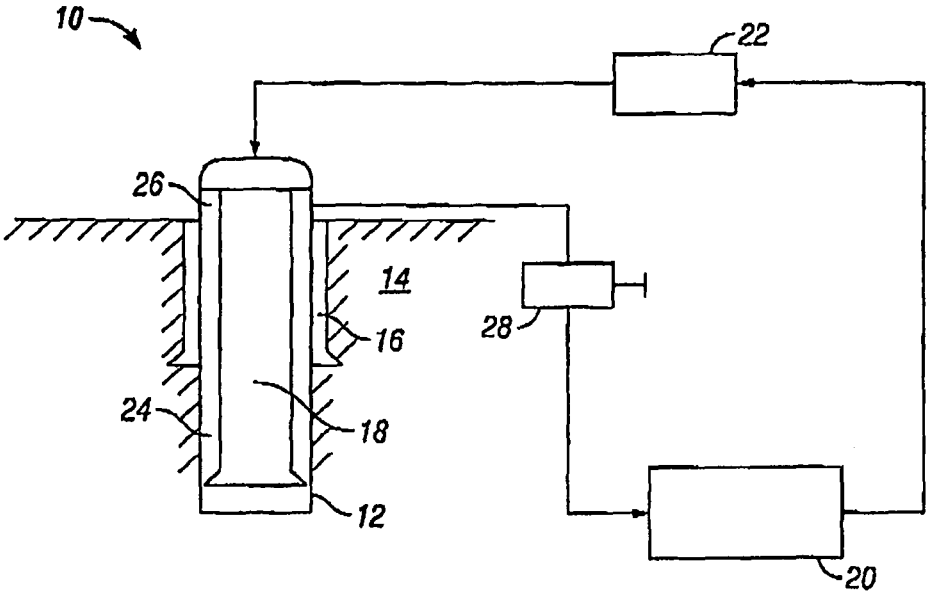
FIG. 1 (Prior Art)
FIG. 1 is a schematic illustration of an embodiment of a conventional oil or gas well.
Figure 2:
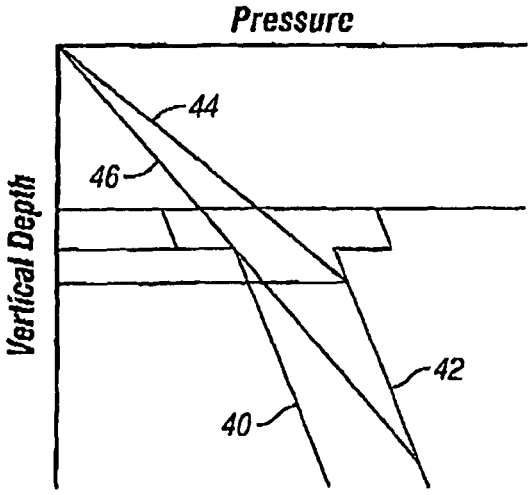
FIG. 2 is a graph depicting annular pressures and formation pore and fracture pressures.
Figure 3:
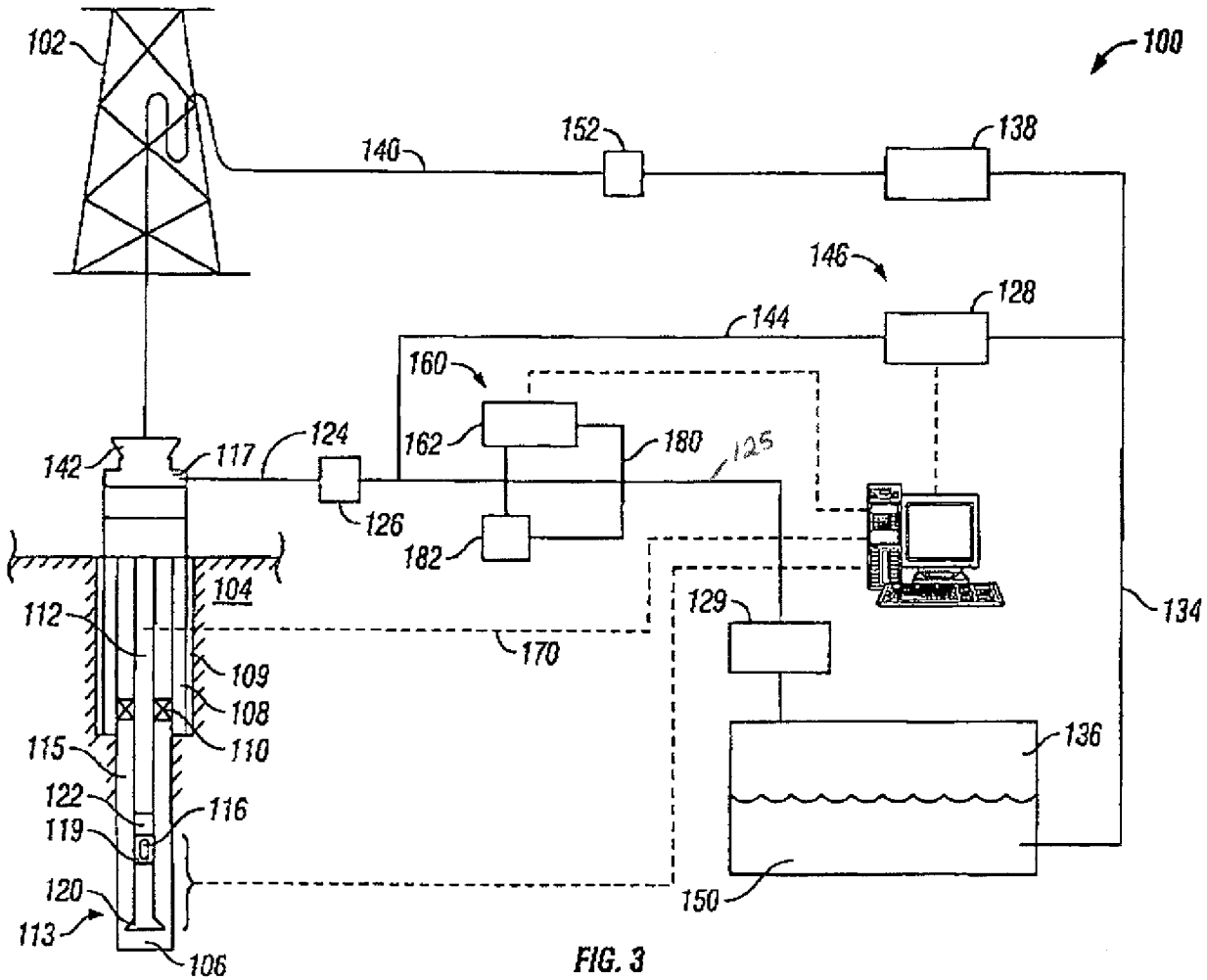
FIG. 3 is a plan view of an embodiment of the apparatus of the invention.

Referring to FIG. 3, an embodiment of an apparatus for maintaining pressure in a wellbore during drilling operations is shown. While FIG. 3 is a plan view depicting a surface drilling system employing the current invention, it will be appreciated that an offshore drilling system may likewise employ the current invention. The drilling system 100 is shown as being comprised of a drilling rig 102 that is used to support drilling operations. Many of the components used on a rig 102, such as the kelly, power tongs, slips, draw works, and other equipment are not shown for ease of depiction. The rig 102 is used to support drilling and exploration operations in formation 104. The borehole 106 has already been partially drilled, casing 108 set and cemented 109 into place. In one embodiment, a casing shutoff mechanism, or downhole deployment valve 110, is installed in the casing 108 to optionally shutoff the annulus and effectively act as a valve to shut off the open hole section when the bit is located above the valve.

The drill string 112 supports a bottom hole assembly (BHA) 113 that includes a drill bit 120, a mud motor, a MWD/LWD sensor suite 119, including a pressure transducer 116 to determine the annular pressure, a check valve, to prevent backflow of fluid from the annulus. It also includes a telemetry package 122 that is used to transmit pressure, MWD/LWD as well as drilling information to be received at the surface. While FIG. 3 illustrates a BHA utilizing a mud telemetry system, it will be appreciated that other telemetry systems, such as radio frequency (RF), electromagnetic (EM) or drilling string transmission systems may be employed within the present invention.

As noted above, the drilling process requires the use of a drilling fluid 150, which may be stored in reservoir 136. It will be appreciated that the reservoir 136 may be a mud tank, pit, or any type of container that can accommodate a drilling fluid.

The reservoir 136 is in fluid communications with one or more mud pumps 138 which pump the drilling fluid 150 through conduit 140. An optional flow meter 152 can be provided in series with the one or more mud pumps, either upstream or downstream thereof. The conduit 140 is connected to the last joint of the drill string 112 that passes through a rotating control device (RCD) 142. An RCD 142 isolates the pressure in the annulus while still permitting drill string rotation. The fluid 150 is pumped down through the drill string 112 and the BHA 113 and exits the drill bit 120, where it circulates the cuttings away from the bit 120 and returns them up the open hole annulus 115 and then the annulus formed between the casing 108 and the drill string 112. The fluid 150 returns to the surface and goes through diverter 117 located in the RCD 142, through conduit 124 to an assisted well control system 160 and various solids control equipment 129, such as, for example, a shaker. The assisted well control system 160 will be described in greater detail below.

In conduit 124, a second flow meter 126 may be provided. The flow meter 126 may be a mass-balance type or other high-resolution flow meter. It will be appreciated that by monitoring flow meters 126, 152 and the volume pumped by the backpressure pump 128 (described below), the system is readily able to determine the amount of fluid 150 being lost to the formation, or conversely, the amount of formation fluid leaking to the borehole 106. Based on differences in the amount of fluid 150 pumped versus fluid 150 returned, the operator is able to determine whether fluid 150 is being lost to the formation 104, which may indicate that formation fracturing has occurred, i.e., a significant negative fluid differential. Likewise, a significant positive differential would be indicative of formation fluid entering into the well bore.

After being treated by the solids control equipment 129, the drilling fluid is directed to mud tank 136. Drilling fluid from the mud tank 136 is directed through conduit 134 back to conduit 140 and to the drill string 112. A backpressure line 144, located upstream from the mud pumps 138, fluidly connects conduit 134 to what is generally referred to as a backpressure system 146. In one embodiment, shown in FIG. 4, a three-way valve 148 is placed in conduit 134. This valve 148 allows fluid from the mud lank 136 to be selectively directed to the rig pump 138 to enter the drill string 112 or directed to the backpressure system 146. In another embodiment, the valve 148 is a controllable variable valve, allowing a variable partition of the total pump output to be delivered to the drill string 112 on the one side and to backpressure line 144 on the other side. This way, the drilling fluid can be pumped both into the drill string 112 and the backpressure system 146. In one embodiment, shown in FIG. 5, a three-way fluid junction 154 is provided in conduit 134, and a first variable flow restricting device 156 is provided between the three way fluid junction 154 and the conduit 140 to the rig pump 138, and a second variable flow restricting device 158 is provided between the three way fluid junction 154 and the backpressure line 144. Thus, the ability to provide adjustable backpressure during the entire drilling and completing processes is provided.

Turning back to FIG. 3, the backpressure pump 128 is provided with fluid from the reservoir through conduit 134, which is in fluid communications with the reservoir 136. While fluid from conduit 125, located downstream from the assisted well control system 160 and upstream from solids control equipment 129 could be used to supply the backpressure system 146 with fluid, it will be appreciated that fluid from reservoir 136 has been treated by solids control equipment 129. As such, the wear on backpressure pump 128 is less than the wear of pumping fluid in which drilling solids are still present.

In one embodiment, the backpressure pump 128 is capable of providing up to approximately 2200 psi (15168.5 kPa) of backpressure; though higher pressure capability pumps may be selected. The backpressure pump 128 pumps fluid into conduit 144, which is in fluid communication with conduit 124 upstream of the assisted well control system 160. As previously discussed, fluid from the annulus 115 is directed through conduit 124. Thus, the fluid from backpressure pump 128 effects a backpressure on the fluid in conduit 124 and back into the annulus 115 of the borehole.

Figure 6:
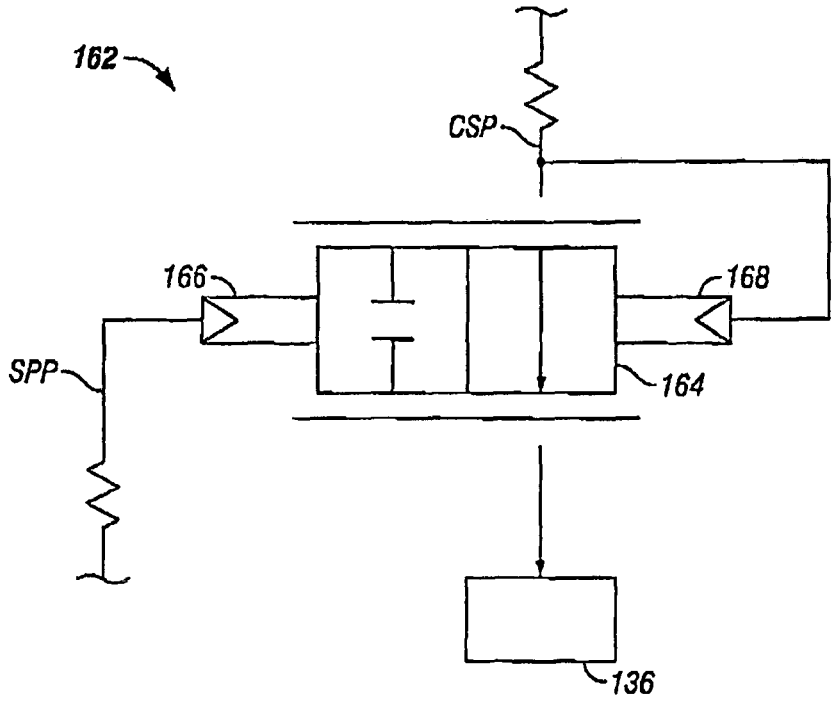
FIG. 6 is an embodiment of the automatic choke utilized in an embodiment of the apparatus of the invention.

The assisted well control system, shown in FIG. 3 includes an automatic choke 162 to controllably bleed off pressurized fluid from the annulus 115. As shown in FIG. 6, the automatic choke 162 includes a movable valve element 164. The position of the valve element 164 is controlled by a first control pressure signal 166, and an opposing second control pressure signal 168. By contrast, fixed position chokes used in some prior art versions of closed loop systems, rely on signals obtained and relayed outside of the choke to adjust the opening through the choke and cannot, therefore, readily adapt to rapid pressure changes. It will be appreciated that the advantage of an automatic choke is that rapid pressure increases, decreases, and spikes that occur in the second control pressure signal are dampened by the first opposing pressure signal.

In one embodiment the first control pressure signal 166 is representative of a set point pressure (SPP) that is generated by a control system 184 (described below and shown in FIG. 7), and the second control pressure signal 168 is representative of the casing pressure (CSP). In this manner, if the CSP is greater than the SPP, pressurized fluidic materials within the annulus 115 are bled off into the mud tank 136. Conversely, if the CSP is equal to or less than the SPP, then the pressurized fluidic materials within the annulus 115 are not bled off into the mud tank 136. In this manner, the automatic choke 162 controllably bleeds off pressurized fluids from the annulus 115 and thereby also controllably facilitates the maintenance of back pressure in the borehole 106 that is provided by the backpressure system 146. In an exemplary embodiment, the automatic choke 162 is further provided substantially as described in U.S. Pat. No. 6,253,787, the disclosure of which is incorporated herein by reference.

Figure 4:
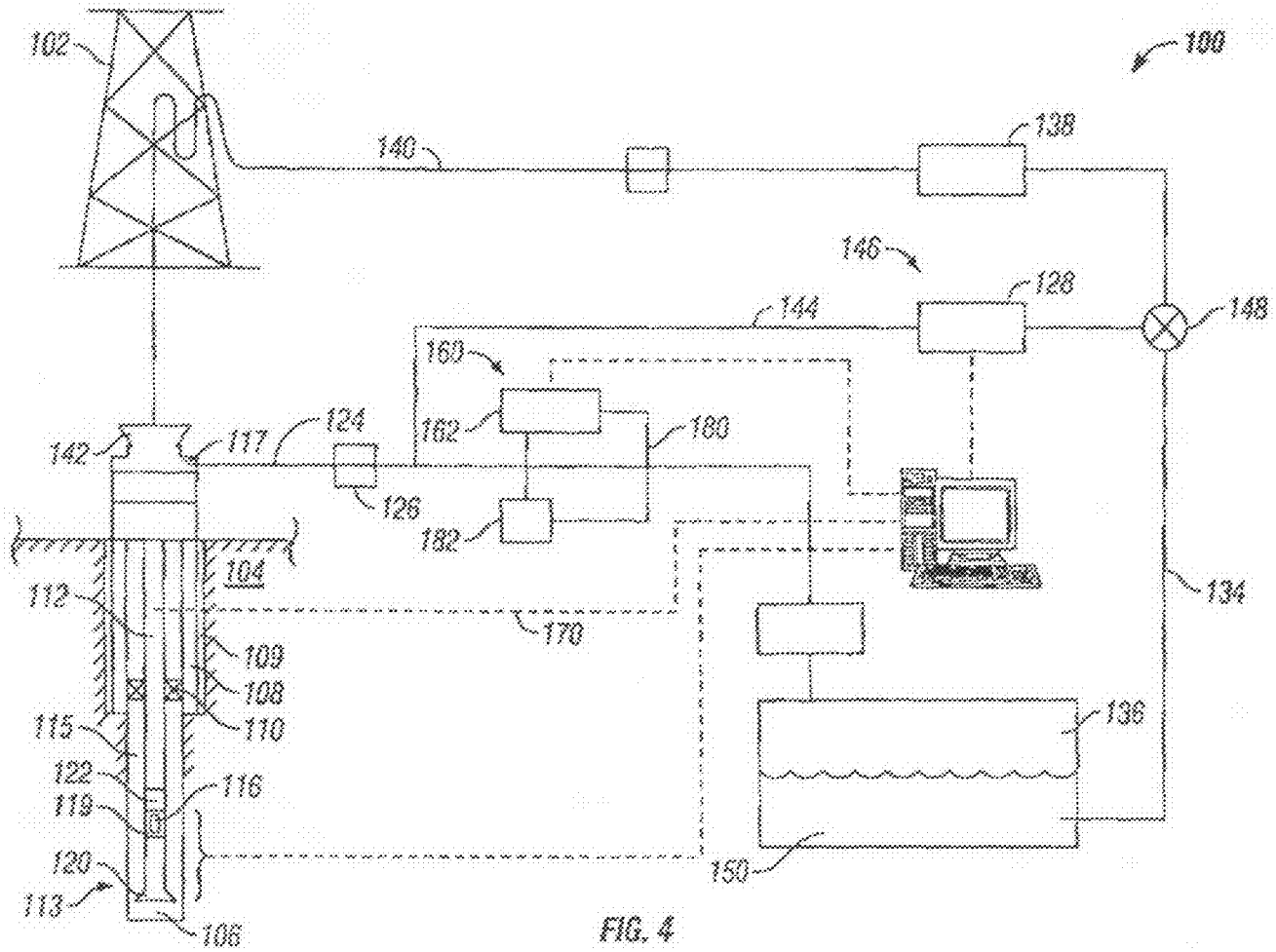
FIG. 4 is a plan view of an embodiment of the apparatus of the invention.
Figure 5:
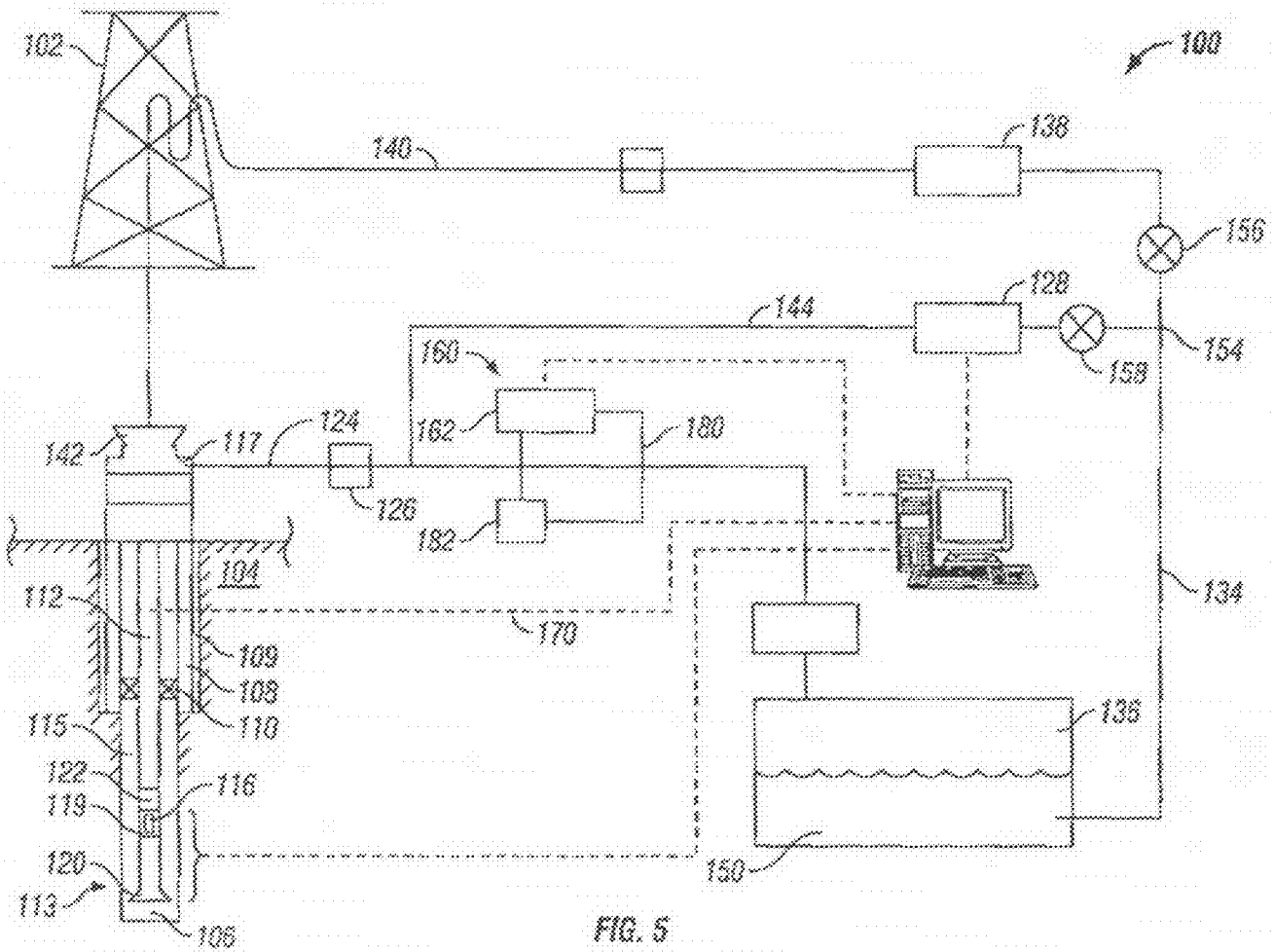
FIG. 5 is a plan view of an embodiment of the apparatus of the invention.

Referring to FIGS. 3-5, automatic choke 162 may be incorporated on a choke manifold 180. A back up choke 182 may also be incorporated onto the choke manifold 180. Valves (not shown) on the manifold 180 may be selectively actuated to divert fluid from conduit 124 through back up choke 182. Such diversion of flow through back up choke 182 may be desirable, for example, when the automatic choke 162 needs to be taken out of service for maintenance. Flow may be selectively returned to the automatic choke 162 when maintenance is complete.

Figure 7:
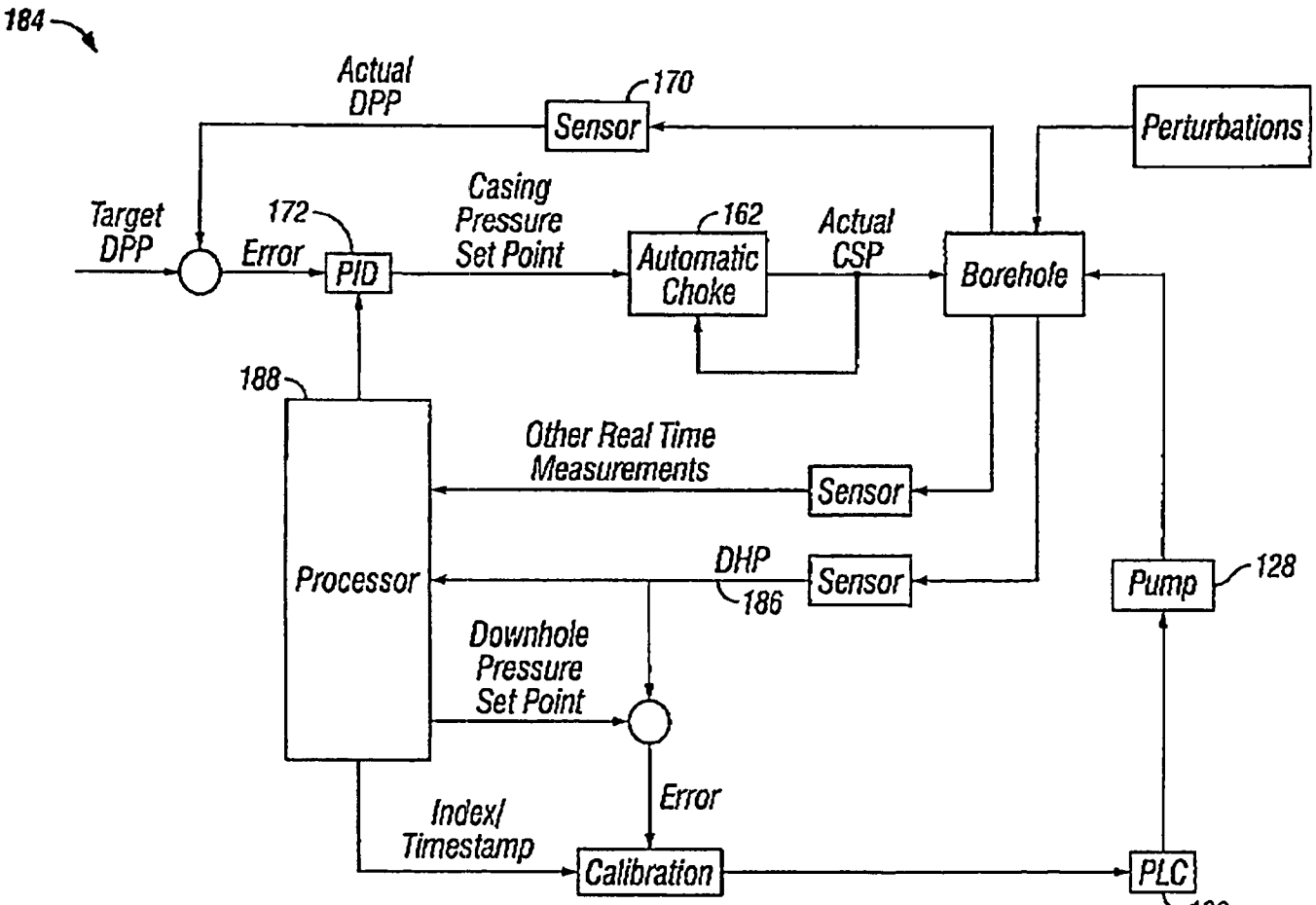
FIG. 7 is a block diagram of the pressure monitoring and control system utilized in an embodiment of the invention.

Referring to FIG. 7, a block diagram includes the control system 184 of an embodiment of the present invention. System inputs to the control system 184 include the downhole pressure (DHP) 186 that has been measured by sensor package 119, transmitted by MWD pulser package 122 and received by transducer equipment (not shown) on the surface. Other system inputs include pump pressure, input flow from flow meter 152, penetration rate and string rotation rate, as well as weight on bit (WOB) and torque on bit (TOB) that may be transmitted from the BHA 113 up the annulus as a pressure pulse. Return flow is measured using flow meter 126. Signals representative of the data inputs are transmitted to a control unit (not shown), which is it self comprised of a drill rig control unit (not shown), a drilling operator's station (not shown), a processor 188 and a back pressure programmable logic controller (PLC) 190, all of which are connected by a common data network. The processor 188 serves several functions, including monitoring the state of the borehole pressure during drilling operations, predicting borehole response to continued drilling, issuing commands to the backpressure PLC to control the backpressure pump 128, and issuing commands to a PID controller 172 to control the automatic choke. Logic associated with the processor 188 will be discussed further below.

Continuing to refer to FIG. 7, the assisted well control system 160 may also include a sensor feedback 170 that monitors the actual drill pipe pressure (DPP) value within the drill string 112 using the output signal of a sensor. The actual DPP value provided by the sensor feedback 170 is then compared with the target DPP value to generate a DPP error that is processed by a proportional-integral-differential (PID) controller 172 to generate an hydraulic SPP. A PID controller includes gain coefficients, Kp, Ki, and Kd, that are multiplied by the error signal, the integral of the error signal, and the differential of the error signal, respectively.

The processor 188 includes programming to carry out Control functions and Real Time Model Calibration functions. The processor 188 receives data from various sources and continuously calculates in real time the correct backpressure set-point based on the input parameters. The backpressure set-point is then transferred to the programmable logic controller 190, which generates the control signals for backpressure pump 128. The input parameters for the backpressure set point calculation fall into three main groups. The first are relatively fixed parameters, including parameters such as well and casing string geometry, drill bit nozzle diameters, and well trajectory. While it is recognized that the actual well trajectory may vary from the planned trajectory, the variance may be taken into account with a correction to the planned trajectory. Also within this group of parameters are temperature profile of the fluid in the annulus and the fluid composition. As with the trajectory parameters, these are generally known and do not change over the course of the drilling operations. One objective is keeping the fluid density and composition relatively constant, using backpressure to provide the additional pressure to control the annulus pressure.

The second group of parameters are variable in nature and are sensed and logged in real time. The common data network provides this information to the processor 188. This information includes flow rate data provided by both downhole and return flow meters 152 and 126, respectively, the drill string rate of penetration (ROP) or velocity, the drill string rotational speed, the bit depth, and the well depth, the latter two being derived from rig sensor data. The last parameter is the downhole pressure data that is provided by the downhole MWD/LWD sensor suite 119 and transmitted back up the annulus by the mud pulse telemetry package 122. One other input parameter is the set-point downhole pressure, the desired annulus pressure.

In one embodiment, a feedforward control is included. As will be recognized by persons having ordinary skill in the art, feedforward control refers to a control system in which set point changes or perturbations in the operating environment can be anticipated and processed independent of the error signal before they can adversely affect the process dynamics. In an exemplary embodiment, the feedforward control anticipates changes in the drill pipe SPP and/or perturbations in the operating environment for the bore hole 106. As used herein, the term "perturbation" refers to an externally-generated undesired input signal affecting the value of the controlled output.

The hydraulic drill pipe SPP is processed by the automatic choke 162 to control the actual CSP. The actual CSP is then "processed" by the bore hole 106 to adjust the actual DPP. Thus, the system 160 maintains the actual DPP within a predetermined range of acceptable values.

The processor 188 includes a control module to calculate the pressure in the annulus over its fill well bore length utilizing various models designed for various formation and fluid parameters. The pressure in the well bore is a function not only of the pressure or weight of the fluid column in the well, but includes the pressures caused by drilling operations, including fluid displacement by the drill string, frictional losses returning up the annulus, and other factors. In order to calculate the pressure within the well, the control module considers the well as a finite number of segments, each assigned to a segment of well bore length. In each of the segments the dynamic pressure and the fluid weight is calculated and used to determine the pressure differential for the segment. The segments are summed and the pressure differential for the entire well profile is determined.

It is known that the flow rate of the fluid 150 being pumped downhole is proportional to the flow velocity of fluid 150 and may be used to determine dynamic pressure loss as the fluid is being pumped downhole. The fluid 150 density is calculated in each segment, taking into account the fluid compressibility, estimated cutting loading and the thermal expansion of the fluid for the specified segment, which is itself related to the temperature profile for that segment of the well. The fluid viscosity at the temperature profile for the segment is also instrumental in determining dynamic pressure losses for the segment. The composition of the fluid is also considered in determining compressibility and the thermal expansion coefficient. The drill string ROP is related to the surge and swab pressures encountered during drilling operations as the drill string is moved into or out of the borehole. The drill string rotation is also used to determine dynamic pressures, as it creates a frictional force between the fluid in the annulus and the drill string. The bit depth, well depth, and well/string geometry are all used to help create the borehole segments to be modeled. In order to calculate the weight of the fluid, the preferred embodiment considers not only the hydrostatic pressure exerted by fluid 150, but also the fluid compression, fluid thermal expansion and the cuttings loading of the fluid seen during operations. It will be appreciated that the cuttings loading can be determined as the fluid is returned to the surface and reconditioned for further use. All of these factors go into calculation of the "static pressure".

Dynamic pressure considers many of the same factors in determining static pressure. However, it further considers a number of other factors. Among them is the concept of laminar versus turbulent flow. The flow characteristics are a function of the estimated roughness, hole size and the flow velocity of the fluid. The calculation also considers the specific geometry for the segment in question. This would include borehole eccentricity and specific drill pipe geometry (box/pin upsets) that affect the flow velocity seen in the borehole annulus. The dynamic pressure calculation further includes cuttings accumulation downhole, as well as fluid rheology and the drill string movement's (penetration and rotation) effect on dynamic pressure of the fluid.

The pressure differential for the entire annulus is calculated and compared to the down hole set-point pressure in the control module. The desired backpressure is then determined and passed on to programmable logic controller 190, which generates control signals for the backpressure pump 128.

The above discussion of how backpressure is generally calculated utilized several downhole parameters, including downhole pressure and estimates of fluid viscosity and fluid density. These parameters are determined downhole and transmitted up the mud column using pressure pulses. Because the data bandwidth for mud pulse telemetry is very low and the bandwidth is used by other MWD/LWD functions, as well as drill string control functions, downhole pressure, fluid density and viscosity can not be input to a model based on dynamic annular pressure control on a real time basis. Accordingly, it will be appreciated that there is likely to be a difference between the measured downhole pressure, when transmitted up to the surface, and the predicted downhole pressure for that depth. When such occurs a dynamic annular pressure control system computes adjustments to the parameters and implements them in the model to make a new best estimate of downhole pressure. The corrections to the model may be made by varying any of the variable parameters. In the preferred embodiment, the fluid density and the fluid viscosity are modified in order to correct the predicted downhole pressure. Further, in the present embodiment the actual downhole pressure measurement is used only to calibrate the calculated downhole pressure. It is not utilized to predict downhole annular pressure response. If downhole telemetry bandwidth increases, it may then be practical to include real time downhole pressure and temperature information to correct the model.

The control system 184 characterizes the transient behavior of the CSP and/or the DPP and then updates the modeling of the overall transfer function for the system. Based upon the updated model of the overall transfer function for the system, the system 184 then modifies the gain coefficients for the PID controller 172 in order to optimally control the DPP and BHP. The system 184 further adjusts the gain coefficients of the PID controller 172 and the modeling of the overall transfer function of the system as a function of the degree of convergence, divergence, or steady state offset between the theoretical and actual response of the system.

Because there is a delay between the measurement of downhole pressure and other real time inputs, the control system 184 further operates to index the inputs such that real time inputs properly correlate with delayed downhole transmitted inputs. The rig sensor inputs, calculated pressure differential and backpressure pressures, as well as the downhole measurements, may be "time-stamped" or "depth-stamped" such that the inputs and results may be properly correlated with later received downhole data. Utilizing a regression analysis based on a set of recently time-stamped actual pressure measurements, the model may be adjusted to more accurately predict actual pressure and the required backpressure.

The use of the disclosed control system permits an operator to make essential step changes in the annular pressure. In response to the pressure increase seen in a pore pressure, the back pressure may be increased to step change the annular pressure in response to increasing pore pressure, in contrast with normal annular pressure techniques. The system further offers the advantage of being able to decrease the back pressure in response to a decrease in pore pressure. It will be appreciated that the difference between the maintained annular pressure and the pore pressure, known as the overbalance pressure, is significantly less than the overbalance pressure seen using conventional annular pressure control methods. Highly overbalanced conditions can adversely affect the formation permeability be forcing greater amounts of borehole fluid into the formation.

It is understood that variations may be made in the foregoing without departing from the scope of the invention. For example, any choke capable of being controlled with a set point signal may be used in the system 100. Furthermore, the automatic choke 162 may be controlled by a pneumatic, hydraulic, electric, and/or a hybrid actuator and may receive and process pneumatic, hydraulic, electric, and/or hybrid set point and control signals. In addition, the automatic choke 162 may also include an embedded controller that provides at least part of the remaining control functionality of the system 184. Furthermore, the PID controller 172 and the control block 184 may, for example, be analog, digital, or a hybrid of analog and digital, and may be implemented, for example, using a programmable general purpose computer, or an application specific integrated circuit. Finally, as discussed above, the teachings of the system 100 may be applied to the control of the operating pressures within any borehole formed within the earth including, for example, a oil or gas production well, an underground pipeline, a mine shaft, or other subterranean structure in which it is desirable to control the operating pressures.

In one aspect embodiments disclosed herein relate to a method for controlling annular pressure in a borehole, the method including the steps of directing drilling fluid through a drill string and up an annulus between the drill string and the borehole, inputting a plurality of parameters to a processor, calculating set point pressure for a backpressure pump, providing backpressure into the annulus with the backpressure pump, controllably bleeding off pressurized fluid from the annulus with an automatic choke, wherein controllably bleeding off pressurized fluid from the annulus includes the steps of generating a casing set point pressure signal, sensing an actual casing pressure and generating an actual casing pressure signal, calculating an error signal from the casing set point pressure signal and the actual casing pressure signal, processing the error signal with a PID controller and adjusting the automatic choke with the PID controller.

In another aspect embodiments disclosed herein relate to a method for creating an equivalent circulation density in a subterranean borehole when one or more rig pumps are started or stopped, the method including the steps of directing drilling fluid through a drill string and up an annulus between the drill string and the borehole, inputting a plurality of parameters to a processor, calculating set point pressure for a backpressure pump, providing backpressure into the annulus with the backpressure pump, controllably bleeding off pressurized fluid from the annulus with an automatic choke, wherein controllably bleeding off pressurized fluid from the annulus includes the steps of generating a casing set point pressure signal, sensing an actual casing pressure and generating an actual casing pressure signal, calculating an error signal from the casing set point pressure signal and the actual casing pressure signal, processing the error signal with a PID controller and adjusting the automatic choke with the PID controller.

In another aspect embodiments disclosed herein relate to a method for controlling formation pressure in a subterranean borehole during drilling operations, the method including the steps of directing drilling fluid through a drill string and up an annulus between the drill string and the borehole, inputting a plurality of parameters to a processor, calculating set point pressure for a backpressure pump, providing backpressure into the annulus with the backpressure pump, controllably bleeding off pressurized fluid from the annulus with an automatic choke, wherein controllably bleeding off pressurized fluid from the annulus includes the steps of generating a casing set point pressure signal, sensing an actual casing pressure and generating an actual casing pressure signal, calculating an error signal from the casing set point pressure signal and the actual casing pressure signal, processing the error signal with a PID controller and adjusting the automatic choke with the PID controller.

While the claimed subject matter has been described with respect to a limited number of embodiments, those skilled in the art, having benefit of this disclosure, will appreciate that other embodiments can be devised which do not depart from the scope of the claimed subject matter as disclosed herein. Accordingly, the scope of the claimed subject matter should be limited only by the attached claims.

What is claimed is:

1. An apparatus for maintaining pressure in a wellbore during drilling operations, wherein the wellbore has casing set and cemented into place, the apparatus comprising:

a reservoir containing fluid from the wellbore;

a drill string in fluid communication with the reservoir, wherein an annulus is defined between the wellbore and the drill string;

a pressure transducer in the drill string to measure pressure in the annulus;

a rotating control device isolating pressure in the annulus and communicating fluid from the reservoir to the drill string and diverting fluid and solids from the annulus;

a first flow meter for measuring a flow rate of fluid and solids diverted from the annulus;

an adjustable choke in fluid communication with the rotating control device controllablly bleeding off pressurized fluid from the annulus, wherein the adjustable choke has a valve element with a position controlled by a first control pressure signal and an opposing second control pressure signal;

solids control equipment receiving fluid and solids from the adjustable choke and removing the solids from the fluid;

a fluid conduit for directing fluid from the solids control equipment to the reservoir;

a processor receiving the measured pressure from the pressure transducer and calculating a set point backpressure; and a backpressure pump in fluid communication with the reservoir and applying a backpressure between the first flow meter and the adjustable choke based on the calculated set point.

2. The apparatus of claim 1, further comprising a second flow meter between the reservoir and the drill string for measure a flow rate therethrough;

wherein the processor is configured to determine an amount of fluid lost or gained in the wellbore based on the flow rate measure by the first flow meter and the second flow meter and a flow rate of the fluid pumped by the backpressure pump.

3. The apparatus of claim 1, further comprising:

a proportional-integral-differential (PID) controller receiving communication from the processor;

wherein the PID controller generated an hydraulic set point pressure and applies it to the choke;

wherein the backpressure pump is controlled by the programmable logic controller based on the set point downhole pressure.

4. The apparatus of claim 1, further comprising:

a programmable logic controller for controlling the backpressure pump;

wherein the processor calculates a set point downhole pressure and transmits the set point downhole pressure to the programmable logic controller;

wherein the backpressure pump is controlled by the programmable logic controller based on the set point downhole pressure.

5. The apparatus of claim 1, wherein the backpressure pump provides up to approximately 2200 psi of backpressure.

6. The apparatus of claim 1, further comprising:

a choke manifold;

a backup choke on the choke manifold;

wherein the choke and the backup choke are selectively in fluid communication with the rotating control device controllablly bleeding off pressurized fluid from the annulus.

* * * * *